US008622175B2

(12) United States Patent
Nielsen

(10) Patent No.: US 8,622,175 B2
(45) Date of Patent: Jan. 7, 2014

(54) COLLAPSIBLE LADDER

(75) Inventor: Otto Martinus Nielsen, Hørsholm (DK)

(73) Assignee: Patentselskabet af 10. december 2010 ApS, Roskilde (DE)

( * ) Notice: Subject to any disclaimer, the term of this patent is extended or adjusted under 35 U.S.C. 154(b) by 107 days.

(21) Appl. No.: 13/130,996

(22) PCT Filed: Nov. 20, 2009

(86) PCT No.: PCT/DK2009/000244
§ 371 (c)(1),
(2), (4) Date: Jun. 21, 2011

(87) PCT Pub. No.: WO2010/060429
PCT Pub. Date: Jun. 3, 2010

(65) Prior Publication Data

US 2011/0247897 A1 Oct. 13, 2011

(30) Foreign Application Priority Data

Nov. 28, 2008 (DK) ..... 2008 01684
Dec. 16, 2008 (DK) ..... 2008 01787
Jan. 9, 2009 (DK) ..... 2009 00032

(51) Int. Cl.
*E06C 1/12* (2006.01)

(52) U.S. Cl.
USPC ..... 182/195; 182/207; 182/209; 182/228.4; 182/228.6

(58) Field of Classification Search
USPC ..... 182/195, 207, 209, 228.1, 228.4, 228.6
See application file for complete search history.

(56) References Cited

U.S. PATENT DOCUMENTS 2,127,949 A * 8/1938 Zeman ..... 182/104
2,542,398 A * 2/1951 Crumpton ..... 182/195

(Continued)

FOREIGN PATENT DOCUMENTS

EP 1402143 A 3/2004
WO WO 91/15651 A1 10/1991

OTHER PUBLICATIONS

International Preliminary Report on Patentability mailed Jun. 9, 2011 for International Application No. PCT/DK2009/000244.

(Continued)

*Primary Examiner* — Alvin Chin Shue
*Assistant Examiner* — Colleen M Chavchavadze
(74) *Attorney, Agent, or Firm* — Brinks Gilson & Lione

(57) ABSTRACT

A ladder having several collapsible ladder sections (100), each comprising two hollow ladder bars (102, 103) arranged parallel to each other and interconnected by a rung (104), where each collapsible ladder section is telescopically inserted into a lower ladder section. Each ladder bar of a collapsible ladder section has a locking hole (111) and an extension (112) below the locking hole. Retaining mechanisms (106) are provided in the rungs for locking the collapsible ladder sections relative to one another, and the retaining mechanisms comprise a locking pin (108), which can engage a corresponding locking hole provided in the ladder bar of a ladder section positioned there above. At least part of the collapsible ladder sections have a non-locking slot or groove (101) formed in the extensions of the ladder bars, where the slot reaches from a distance below the ladder bar to the bottom of the ladder bar. A ladder bar slot or groove may be positioned in such a way that a locking pin of a below lying ladder bar can pass freely in the slot of an above lying ladder section that is fully collapsed.

17 Claims, 6 Drawing Sheets

(56) References Cited

U.S. PATENT DOCUMENTS

| | | | | | |
|---|---|---|---|---|---|
| 2,858,154 | A | * | 10/1958 | Johansson | 403/63 |
| 2,993,561 | A | * | 7/1961 | Watson | 182/195 |
| 3,784,020 | A | * | 1/1974 | Steiner | 211/1.3 |
| 4,119,177 | A | * | 10/1978 | Andersson | 182/195 |
| 4,989,692 | A | * | 2/1991 | Min | 182/166 |
| 5,062,499 | A | * | 11/1991 | Tu | 182/166 |
| 5,645,140 | A | * | 7/1997 | Mouneimneh | 182/195 |
| 5,743,355 | A | * | 4/1998 | McDonnell et al. | 182/195 |
| 6,073,726 | A | * | 6/2000 | McCrystal | 182/195 |
| 6,345,691 | B1 | * | 2/2002 | Ruiz | 182/195 |
| 6,505,707 | B1 | * | 1/2003 | Berry | 182/20 |
| 6,708,800 | B2 | * | 3/2004 | Kieffer et al. | 182/195 |
| 7,967,110 | B2 | * | 6/2011 | Parker | 182/77 |
| 8,011,475 | B2 | * | 9/2011 | Wang | 182/195 |
| 8,056,679 | B2 | * | 11/2011 | Hong | 182/195 |
| 8,104,580 | B2 | * | 1/2012 | Eriksson | 182/195 |
| 8,215,453 | B2 | * | 7/2012 | Mickens | 182/218 |
| 2004/0195043 | A1 | * | 10/2004 | Johansson | 182/195 |
| 2005/0269159 | A1 | * | 12/2005 | Lin | 182/209 |
| 2007/0209875 | A1 | * | 9/2007 | Chen | 182/195 |
| 2007/0267252 | A1 | * | 11/2007 | Yao et al. | 182/195 |

OTHER PUBLICATIONS

Written Opinion mailed Jun. 9, 2011 for International Application No. PCT/DK2009/000244.

International Search Report relating to International Application No. PCT/DK2009/000244, dated May 1, 2010, 2 pgs.

* cited by examiner

Fig. 4b
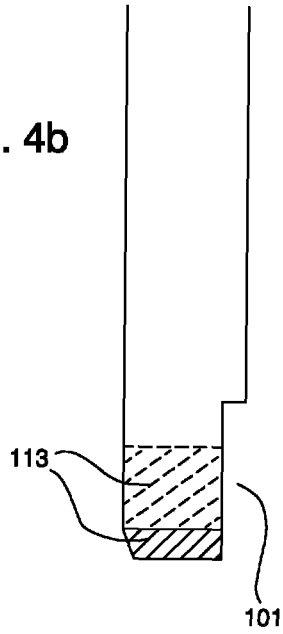
Fig. 4a
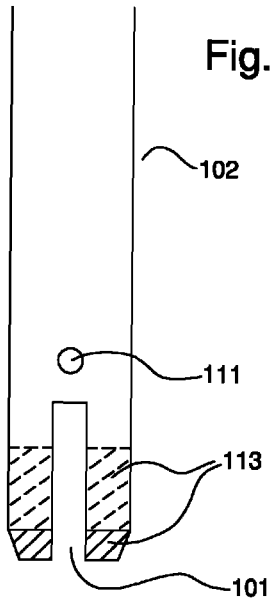
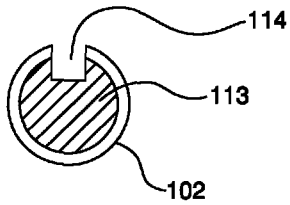
Fig. 4c

Fig. 5a
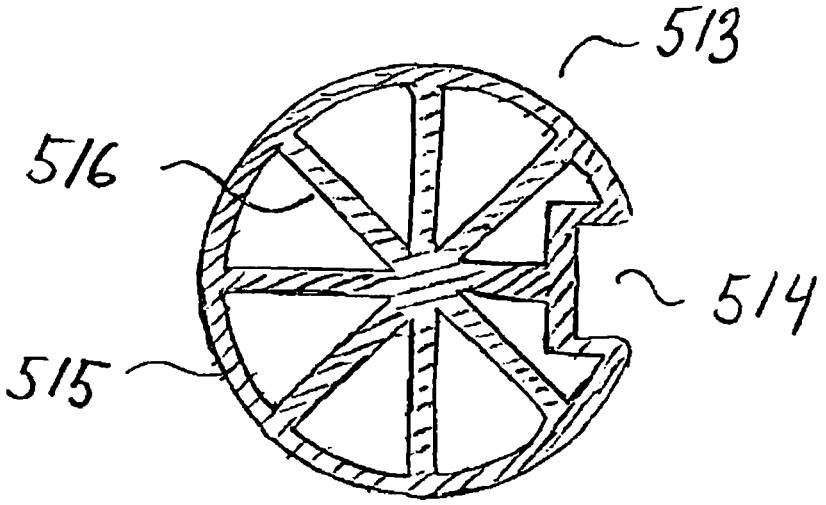
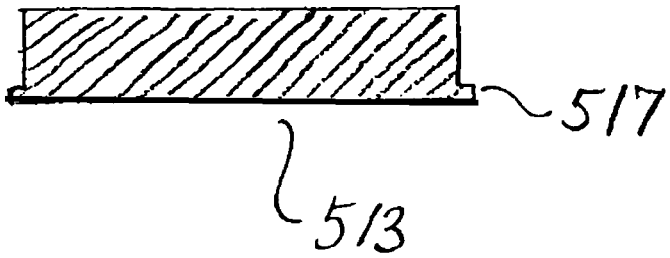
Fig. 5b

COLLAPSIBLE LADDER

This application claims the benefit under 35 U.S.C. §371 of International Application No. PCT/DK2009/000244, filed Nov. 20, 2009, which claims the benefit of Danish Patent Application No. PA 2008 01684, filed Nov. 28, 2008, Danish Patent Application No. PA 2008 01787, filed Dec. 16, 2008, and Danish Patent Application No. PA 2009 00032, filed Jan. 9, 2009, which are incorporated by reference herein in their entirety.

FIELD OF INVENTION

The present invention relates to a collapsible ladder of the type comprising U-shaped ladder sections being telescopically inserted in each other.

BACKGROUND OF THE INVENTION

Ladders having collapsible and expandable ladder sections are used in order to make the ladder smaller for storage and transport purposes.

In the European patent EP-B1-0 527 766 a collapsible ladder is described comprising ladder bars divided into sections interconnected by rungs. In each ladder section is provided retaining or locking mechanisms, designed to automatically release the upper ladder sections, when a rung reaches a lower rung. This means, that subsequent to the release of the lowermost ladder section, the following ladder sections are automatically released, whereby the ladder collapses.

In the European patent EP-B1-1 402 143 another collapsible ladder is described comprising a retaining or locking mechanism on each ladder section. The locking mechanism is provided at both sides of a ladder section and is designed to be manually and individually released at both sides of a ladder section to collapse a ladder section. The locking mechanism on every ladder section needs to be released to completely collapse the ladder. For the locking mechanisms of this ladder, each locking pin has a length, which is sufficient for extending though the locking hole of the ladder section positioned there above and into the hollow space inside the ladder bar, and the ladder bar has an extension below the locking hole, so that when an upper ladder section is released and inserted into an intermediate ladder section, which is locked in relation to a lower ladder section by the locking pin of the lower ladder section, the upper ladder section is stopped from being fully inserted in the intermediate section by a distance in the range of 5-15 cm, by engagement of the extension of the lower ends of the ladder bars of the upper ladder section with the locking pins of the lower ladder section extending through the locking holes into the hollow space of the ladder bars of the intermediate ladder section.

It is to be noticed that when releasing an upper or intermediate ladder section of the ladder described in EP-B1-1 402 143, such a released ladder section will not be fully collapsed before the ladder section below the released ladder section is also released.

Thus, there is a need for a collapsible ladder, which allows the locking pins to extend through the locking holes of the ladder bars, to thereby ensure that the ladder bars are securely held in the extended position, while at the same time, an upper or intermediate ladder section can be fully collapsed, when bringing the locking pins of only the first lower ladder section into the non-locked position. It is an object of the present invention to provide such a telescopically collapsible ladder.

SUMMARY OF THE INVENTION

According to the present invention there is provided a collapsible ladder comprising:

- several collapsible ladder sections, each or at least part of the ladder sections comprising two hollow ladder bars arranged parallel to each other and interconnected at an upper end by a rung, and each collapsible ladder section being telescopically inserted into a lower ladder section;
- wherein each ladder bar of a collapsible ladder section has a locking hole adjacent the lower end part of the ladder bar and an extension below the locking hole;
- wherein retaining mechanisms are provided in the rungs for locking the collapsible ladder sections relative to one another when the collapsible ladder sections are extended, each of or part of said retaining mechanisms comprising a locking pin which can be brought into an extended position in order to engage a corresponding locking hole provided in the ladder bar of a ladder section positioned there above; and
- wherein for one or more of the collapsible ladder sections, a non-locking ladder bar slot or groove is formed in the extension of each of the ladder bars and reaching from a distance below the locking hole of the ladder bar to the bottom of the ladder bar.

It is preferred that the ladder bar slots or grooves provided in the ladder bar extensions of a corresponding ladder section have a width and length allowing the ladder section to be fully collapsed while the locking pins locking a ladder section positioned there below passes freely in the ladder bar slots or grooves.

It is within an embodiment of the invention that for a collapsible ladder section the distance from the lower side of the rung to the locking hole is smaller than or equal to the similar distance for a ladder section positioned there below. However, it is preferred that the distance from the lower side of a rung to the locking hole is the same for each collapsible ladder section.

The present invention also covers one or more embodiments, wherein for one or more of the ladder bars having a non-locking ladder bar slot or groove, a plug is provided at the bottom of the ladder bar and reaching into the lower end of the ladder bar, said plug having a plug slot or groove formed therein, which plug slot or groove matches at least part of the slot or groove of the ladder bar. It is preferred that the plug is solid or at least partly solid. It is also preferred that the plug slot or groove is deep and wide enough to let a locking pin extending through a locking hole of a ladder bar of a locked ladder section positioned there below pass freely.

It is one or more embodiments of the invention that part of or each of the collapsible ladder sections has one or more spacers provided at the bottom of the rung.

It is within an embodiment of the present invention that there is no retaining mechanism in the uppermost rung.

It is preferred that a locking pin is spring biased towards the extended position in order to engage the corresponding locking hole provided in the ladder bar of the ladder section positioned there above. Each retaining mechanism having a locking pin may further comprise an actuator for moving the locking pin into a retracted position. According to an embodiment of the invention, a pair of actuators for moving corresponding locking pins is provided on the front side of at least part of the rungs having retaining mechanisms. According to another embodiment of the invention, a pair of actuators for moving corresponding locking pins is provided at the bottom of at least part of the rungs having retaining mechanisms.

It is preferred that the ladder bars are formed of circular tubing.

According to one or more embodiments of the invention, a connector is provided at each end of the rung of a collapsible ladder section for interconnecting the rung with the two ladder bars. Here, the connector may comprise an annular wall and a shoulder protruding inwards from the annular wall, the inner diameter of the connector and the shoulder being dimensioned for receiving and holding the corresponding ladder bar. According to an embodiment of the invention, one or more protrusions are formed in the connector, with the protrusions being received by correspondingly formed holes in the received ladder bar.

BRIEF DESCRIPTION OF THE DRAWINGS

FIGS. 4*a*, 4*b* and 4*c* show side and bottom views of a ladder bar with a plug according to an embodiment of the invention, FIGS. 5*a* and 5*b* show top at side views of an alternative embodiment of a plug to be inserted into a ladder bar according to an embodiment of the invention.

DETAILED DESCRIPTION OF EMBODIMENTS

Figure 1:
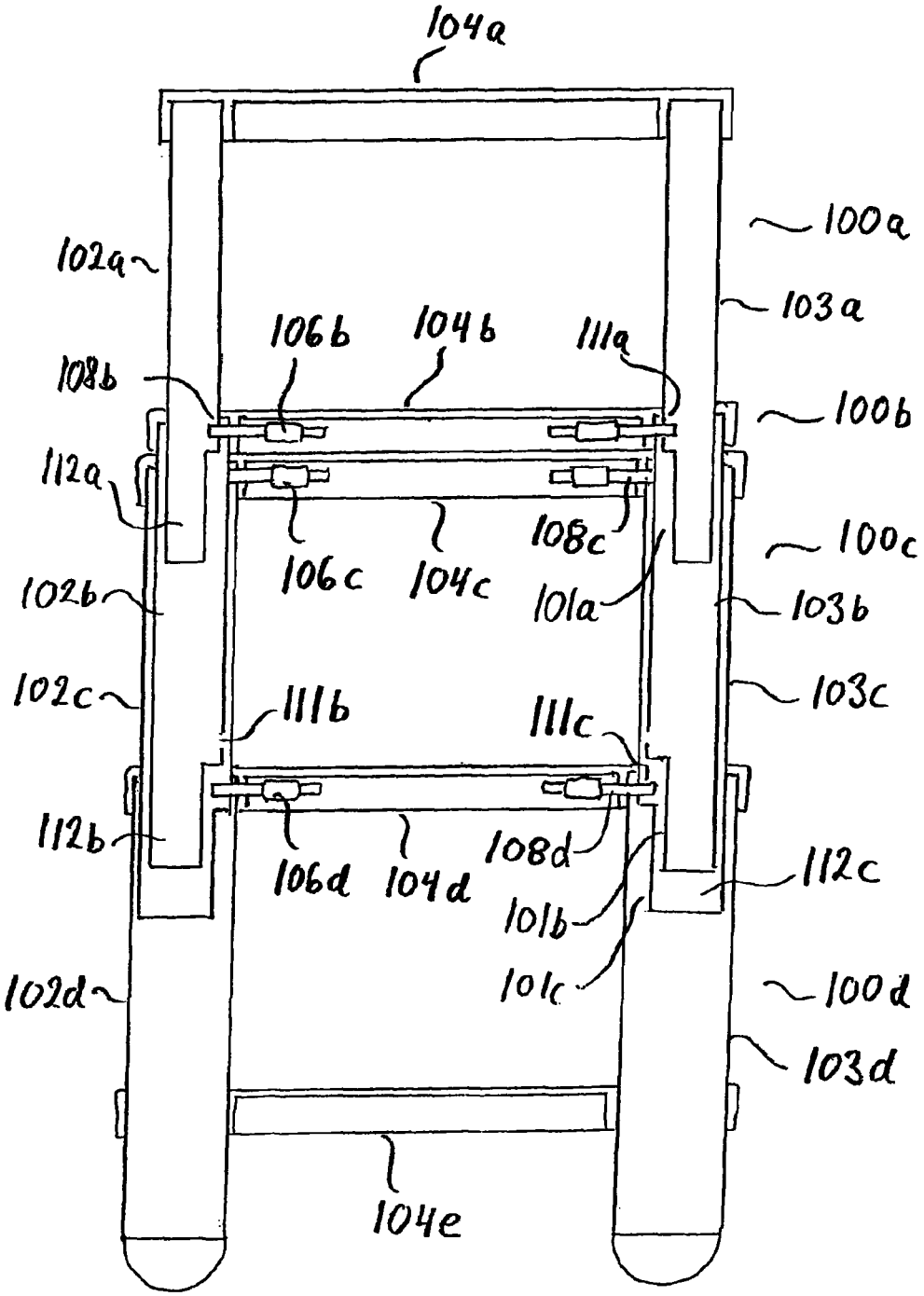
FIG. 1 is a front view of a partly collapsed ladder according to the present invention.

A collapsible ladder according to the invention is illustrated in the drawings. FIG. 1 shows a partly collapsed ladder, where the ladder has a number of collapsible ladder sections 100*a,b,c* with hollow ladder bars 102*a,b,c*, 103*a,b,c*, arranged parallel to each other and interconnected at an upper end by a rung 104*a,b,c*. Each collapsible ladder section 100*a,b,c* is telescopically inserted into a lower ladder section. The lowermost ladder section 100*d*, which is not a collapsible ladder section, has in a preferred embodiment an upper rung 104*d* for interconnecting the ladder bars 102*d*, 103*d* and a lower rung 104*e* to provide an extra foot support and a more stable lowermost ladder section. Each ladder bar 102*a,b,c* and 103*a,b,c* of the collapsible ladder sections 100*a,b,c* has a locking hole 111*a,b,c* adjacent the lower end part of the ladder bar and an extension 112*a,b,c* below the locking hole 111*a,b,c*. It should be understood that the present invention also covers a collapsible ladder wherein the ladder bars 102*a*, 103*a* of the uppermost ladder section 100*a* are not hollow or completely hollow, since there is no ladder section to be inserted from above into this uppermost ladder section 100*a*.

In each of the rungs 104*b,c,d* positioned below the upper rung 104*a*, retaining mechanisms 106*b,c,d* are provided for locking the collapsible ladder sections 100*a,b,c* relative to one another when the collapsible ladder sections are extended. Each of the retaining mechanisms 106*b,c,d* has a locking pin 108*b,c,d*, which can be brought into an extended position in order to engage the corresponding locking hole 111*a,b,c* provided in the ladder bar 104 of a ladder section 100 positioned there above. Furthermore, a non-locking ladder bar slot or groove 101*a,b,c* is formed in the extension 112*a,b,c* of each of the ladder bars 102*a,b,c* 103*a,b,c* and reaching from a distance below the locking hole 111*a,b,c* to the bottom of the ladder bar 102*a,b,c* and 103*a,b,c*. There is no retaining mechanism in the uppermost rung 104*a*.

For the ladder illustrated in FIG. 1, a ladder bar slot or groove 101*a,b,c* is provided in the ladder bars 102*a,b,c* and 103*a,b,c* of all the collapsible ladder bar sections 100*a,b,c*. However, the invention also covers ladders, wherein a ladder bar slot or groove 101 is only provided in the ladder bars 102,103 of part of the collapsible ladder bar sections 100. For the lower most collapsible ladder bar section 100*c* of FIG. 1, there is no need for the slots or grooves 101*c* as there are no locking pins in the lowermost ladder section 100*d*.

For the ladder illustrated in FIG. 1, the uppermost collapsible ladder section 100*a* and the lowermost collapsible ladder section 100*c* are both fully extended, while the intermediate ladder section 100*b* is fully collapsed. In accordance with the principles of the present invention, the intermediate ladder section 100*b* is allowed to be fully collapsed due to the presence of the ladder bar slots or grooves 101*b*, which allows the locking pins 108*d* of the ladder section 100*d* to be in the extended position for locking the ladder section 100*c*.

For the collapsible ladder sections 100*a,b,c* the distance from the lower side of the rung 104*a,b,c* to the locking hole 111*a,b,c* may be smaller than or equal to the similar distance for a ladder section positioned there below, but it is preferred that the distance from the lower side of a rung 104*a,b,c* to the locking hole 111*a,b,c* is the same for each collapsible ladder section 100*a,b,c*.

Figure 2:
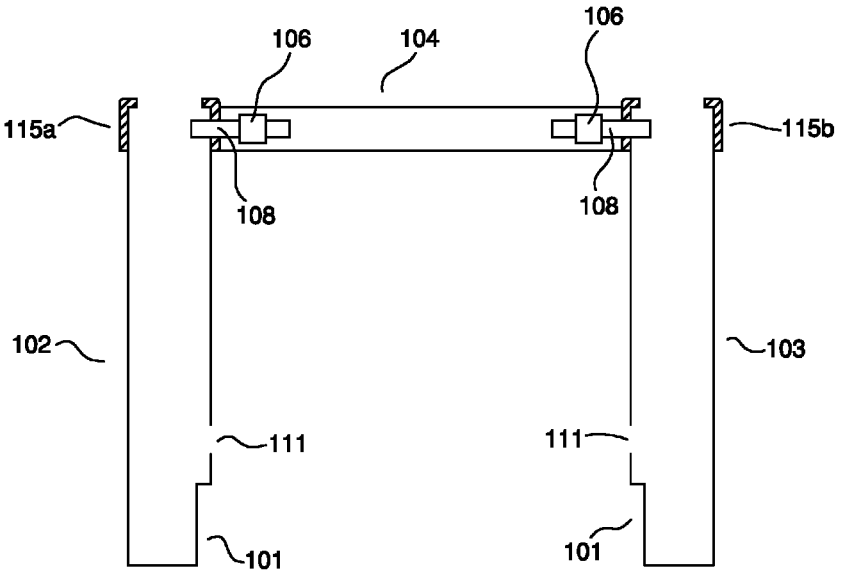
FIG. 2 is a front view of a collapsible ladder section according to an embodiment of the invention.

FIG. 2 is a front view of a collapsible ladder section 100 according to an embodiment of the invention. The ladder section 100 of FIG. 2 has two ladder bars 102, 103 connected by a rung 104, locking holes 111 in each of the ladder bars 102, 103 and a slot or groove 101 in each of the ladder bars 102, 103 below the locking holes 111. A connector 115*a,b* is provided at each end of the rung 104 for interconnecting the rung 104 with the two ladder bars 102, 103. Each connector 115*a,b* comprises an annular wall and a shoulder protruding inwards from the annular wall, where the inner diameter of the connector and the shoulder are dimensioned for receiving and holding the corresponding ladder bar 102, 103. Two protrusions (not shown in FIG. 2) are formed in each connector 115*a,b* and received by correspondingly formed holes in the corresponding ladder bar 102, 103.

Figure 3A:
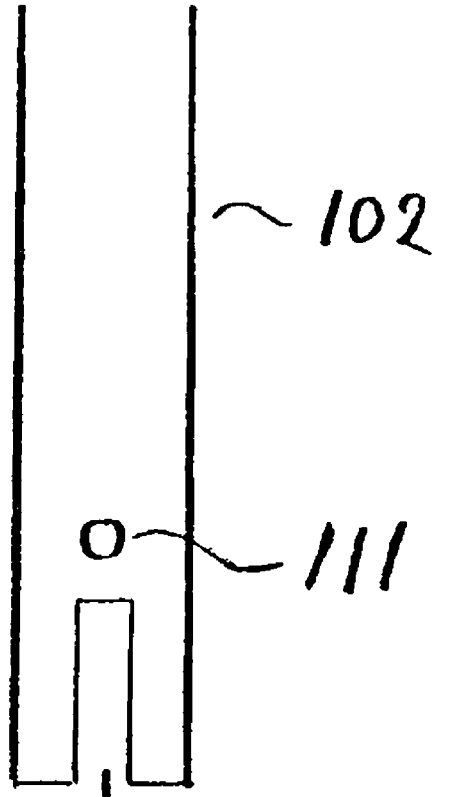
FIGS. 3*a* and 3*b* show side and bottom views of a ladder bar according to an embodiment of the invention.
Figure 3B:
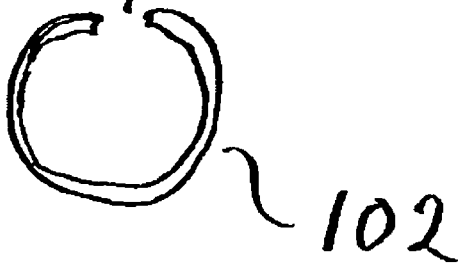

FIGS. 3*a* and 3*b* show side and bottom views of a ladder bar 102 being part of a collapsible ladder section 100 according to an embodiment of the invention. FIGS. 3*a* and 3*b* illustrate the formation of the ladder bar slot or groove 101 reaching from the bottom of the ladder bar 102 to a distance below the locking hole 111. As illustrated in FIG. 3 *b*, the ladder bars 102, 103 are formed of circular tubing.

The width and length of the ladder bar slots or grooves 101 shall be dimensioned so as to allow the corresponding ladder section 100 to be fully collapsed while the locking pins 108 of a ladder section positioned there below passes freely in the ladder bar slots or grooves 101.

FIGS. 4*a*, 4*b* and 4*c* show side and bottom views of a further embodiment of the invention, wherein a plug or stopper 113 is provided at the bottom of the ladder bar 102, which ladder bar is part of a collapsible ladder section. The plug or stopper 113 may reach into the lower end of the ladder bar 102 to thereby increase the strength of the combination of the ladder bar 102 and plug 113. The plug 113 should have a plug slot or groove 114, which should match the slot or groove 101 of the ladder bar 102.

The plug 113 shown in FIG. 4 is solid, but it also within the invention that only part of the plug 113 is solid. The plug slot or groove 114 is formed to be deep and wide enough to let a locking pin 108 extending through a locking hole 111 of a ladder bar 102 of a ladder section 104 positioned there below pass freely.

FIGS. 5*a* and 5*b* show top at side views of an alternative embodiment of a plug 513 to be inserted into a ladder bar according to an embodiment of the invention. The plug 513 is partly solid, and almost formed like a wheel with a rim 515 and spokes 516. The bottom part of the plug 513 is provided with a collar or shoulder 517 having a width corresponding to the thickness of the ladder bars. The plug 513 is to be inserted into the lower end of a ladder bar 102 with the collar or shoulder 517 maintaining the plug 513 at the position at the end of the ladder bar 102. The plug 513 also has a plug slot or groove 514, which matches the slot or groove 101 of the ladder bar 102.

Although not shown in the drawings, the present invention also covers embodiments wherein a thin plastic sleeve is covering the outer bottom part of the ladder bars 102, 103, and thereby also covering the bottom part of the plugs 113, 513. Furthermore, the sleeve is formed with a slot or groove to fit into the groove 101 of the ladder bar 102 and the plug slot or groove 114, 514. The sleeve may have cover about 1 cm of the lower end of a ladder bar 102.

Figure 6:
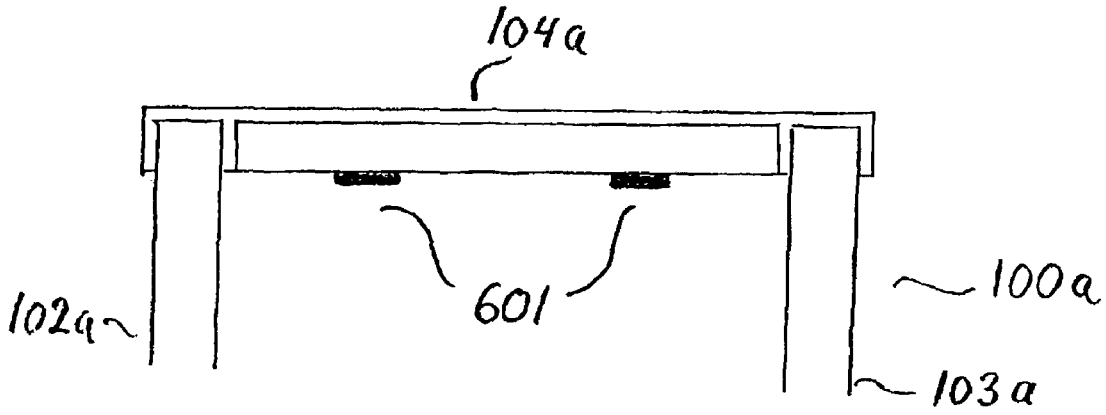
FIG. 6 shows a ladder bar section with spacers provided at the bottom side of the rung according to an embodiment of the invention.

FIG. 6 shows an embodiment of a ladder bar section 100*a* having ladder bars 102*a*, 103*a* and a rung 104*a* connected to the ladder bars 102*a*, 103*a*, and further having two spacers 601 provided at the bottom side of the rung 104*a*. In a preferred embodiment of a collapsible ladder according to the invention, each of the collapsible ladder sections 100*a,b,c* has one or more spacers 601 provided at the bottom of the rung 104*a,b,c*. The spacers 601 may be made of a resilient or partly resilient material such as a rubber material, but the spacers 601 may also be made of a plastic material. The spacers 601 will maintain a distance between the rungs 104*a,b,c,d* of the collapsed ladder.

For the preferred embodiment of the invention, the locking pins 108 are spring biased towards the extended position in order to engage a corresponding locking hole 111 in a ladder bar 102, 103. Also, each retaining mechanism 106 may have an actuator for moving the locking pin 108 into a retracted position. In one embodiment of the invention, then the actuators for moving the corresponding locking pins 108 are provided on the front side of at least part of the rungs 104. For this embodiment it is preferred to have spacers 601 at the bottom of the rungs 104. Collapsible ladders having actuators arranged on the front of the rungs 104 are well known and for example described in EP-B1-1 402 143, which is hereby included by reference.

In another embodiment of the invention, then the actuators for moving the corresponding locking pins 108 are provided at the bottom of at least part of the rungs 104 having retaining mechanisms 106. Collapsible ladders having actuators arranged at the bottom of the rungs 104 are well known and for example described in EP-B1-0 527 766, which is hereby included by reference. When the actuators are arranged at the bottom of the rungs, then subsequent to the release of the lowermost ladder section, the following ladder sections may automatically be released, whereby the ladder collapses.

For the collapsible ladder discussed above in connections with FIGS. 1-6, it is preferred that the ladder bars 102, 103 and the rungs 104 are made of aluminium, which may have a thickness of about 1 mm. The locking pins may be made of steel, and the connectors 115 and the plugs 113, 513 may be made of a plastic material.

According to an embodiment of a collapsible ladder of the invention, the ladder comprises a lowermost ladder section and 10 collapsible ladder sections, where the upper most ladder section has no retaining mechanisms 106. The outer diameter of the ladder bars of the lower most ladder section is about 8 cm and the outer diameter of the ladder bars of the upper most ladder section is about 3 cm. The length of the ladder bars 102, 103 are about 50 cm, with the locking holes 111 having a diameter of about 1 cm and being provided at a distance of about 19-20 cm from the bottom of the ladder bar 102, 103. The ladder bar slots or grooves 101 extend from the bottom of the ladder bar 102, 103 to a distance of 1.5-2 cm below the locking holes 111. The width of the ladder bar slots or grooves 101 is about 1 cm, and the diameter of the locking pins 108 is about 8 mm, thereby making it possible for the locking pins 108 to pass freely within the slots 101. Plastic plugs 113, 513 are provided at the bottom of the ladder bars 102, 103 being part of the collapsible ladder sections, and the plugs 113, 513 are extending in the range of 5-20 mm, such as about 8-10 mm into the ladder bars 102, 103. If plugs 113 are used, the plugs may have an inwardly inclining part extending about 1 cm below the bottom of the ladder bars 102, 103. For the preferred embodiment, wherein the plug 513 of FIG. 5 is used, then the plugs 513 have a shoulder or collar 517 extending below the bottom of the ladder bars 102, 103, with the shoulder or collar 517 having a thickness of about 1 mm and a width of about 1 mm. A plug slot or groove 114, 514 having a width of about 1 cm and a depth of about 1 cm is formed in the plastic plugs 113, 513 with the plug slot 114, 514 being arranged to fit the corresponding ladder bar slot 101. The rungs 104 of the collapsible ladder sections have two rubber spacers 601 provided at the bottom side of the rungs. The spacers 601 have a thickness of about 4-5 mm and a diameter of about 25 mm. The rungs 104 below the upper most rung have a plastic connector 115 at each end. The height of the connectors is about 2.5 cm, and the wall thickness is about 4 mm. The top shoulder of connector 115 has a shoulder protruding inwards with about 1-1.5 mm from the inner part of the connector 115 to thereby stop the corresponding ladder bar 102, 103. The connector 115 also has two circular formed protrusions protruding inwards from inner part of the connector 115 with about 0.5-1 mm, where the protrusions are received by holes in the corresponding ladder bar 102. 103. In order to fastened a connector 115 to a ladder bar 102, the connector wall may be opened and hold together by a screw or bolt.

The present invention has been described herein in connection with preferred embodiments thereof. It will be appreciated that provided the detailed disclosure herein, those skilled in the art may envision how the present invention could be practiced using alternative embodiments and variations thereof. Such variations are intended to be within the scope of the present invention, which is defined by the claims appended hereto.

The invention claimed is:

1. A collapsible ladder comprising:

an uppermost ladder section;

a lowermost ladder section; and several collapsible ladder sections, one or more of the several collapsible ladder sections comprising two hollow ladder bars arranged parallel to each other and interconnected at an upper end by a rung, and each collapsible ladder section being telescopically inserted into a lower ladder section;

wherein each ladder bar of a collapsible ladder section has a locking hole adjacent a lower end part of the ladder bar and an extension below the locking hole;

wherein retaining mechanisms are provided in the rungs for locking the collapsible ladder sections relative to one another when the collapsible ladder sections are extended, one of more of the retaining mechanisms comprising a locking pin which can be brought into an extended position in order to engage a corresponding locking hole provided in the ladder bar of the ladder section positioned there above; and wherein for one or more of the collapsible ladder sections, a non-locking ladder bar slot or groove is formed in the extension of each of the ladder bars and reaching from a distance below the locking hole of the ladder bar to a bottom of the ladder bar.

2. A ladder according to claim 1, wherein the ladder bar slots or grooves provided in the ladder bar extensions of a corresponding ladder section have a width and length allowing the ladder section to be fully collapsed while the locking pins locking the ladder section positioned there below passes freely in the ladder bar slots or grooves.

3. A ladder according to claim 1, wherein for a collapsible ladder section a distance from a lower side of the rung to the locking hole is smaller than or equal to the similar distance for the ladder section positioned there below.

4. A ladder according to claim 1, wherein a distance from a lower side of a rung to the locking hole is the same for each collapsible ladder section.

5. A ladder according to claim 1, wherein for one or more of the ladder bars having the non-locking ladder bar slot or groove, a plug is provided at the bottom of the ladder bar and reaching into a lower end of the ladder bar, said plug having a plug slot or groove formed therein, the plug slot or groove matches at least part of the slot or groove of the ladder bar.

6. A ladder bar according to claim 5, wherein the plug is solid or at least partly solid.

7. A ladder according to claim 5, wherein the plug slot or groove is deep and wide enough to let the locking pin extending through the locking hole of a ladder bar of the locked ladder section positioned there below pass freely.

8. A ladder according to claim 1, wherein the locking pin is spring biased towards the extended position in order to engage said corresponding locking hole provided in the ladder bar of the ladder section positioned there above.

9. A ladder according to claim 1, wherein there is no retaining mechanism in a rung of the uppermost ladder section.

10. A ladder according to claim 1, wherein the ladder bars comprise circular tubing.

11. A ladder according to claim 1, wherein a connector is provided at each end of the rung of a collapsible ladder section for interconnecting the rung with the two ladder bars.

12. A ladder according to claim 11, wherein the connector comprises an annular wall and a shoulder protruding inwards from the annular wall, an inner diameter of the connector and the shoulder being dimensioned for receiving and holding the corresponding ladder bar.

13. A ladder according to claim 2, wherein for a collapsible ladder section a distance from a lower side of the rung to the locking hole is smaller than or equal to the similar distance for the ladder section positioned there below.

14. A ladder according to claim 6, wherein the plug slot or groove is deep and wide enough to let the locking pin extending through the locking hole of a ladder bar of the locked ladder section positioned there below pass freely.

15. A ladder according to claim 1, wherein the lowermost ladder section comprises retaining mechanisms provided in the rungs.

16. A ladder according to claim 1, wherein the uppermost ladder section is telescopically insertable into a collapsible ladder section.

17. A ladder according to claim 1, wherein the uppermost ladder section comprises a ladder bar having a locking hole adjacent a lower end part of the ladder bar and an extension below the locking hole.

* * * * *

UNITED STATES PATENT AND TRADEMARK OFFICE

CERTIFICATE OF CORRECTION

PATENT NO. : 8,622,175 B2
APPLICATION NO. : 13/130996
DATED : January 7, 2014
INVENTOR(S) : Otto Martinus Nielsen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 128 days.

Signed and Sealed this
Twenty-second Day of September, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,622,175 B2
APPLICATION NO. : 13/130996
DATED : January 7, 2014
INVENTOR(S) : Otto Martinus Nielsen It is certified that error appears in the above-identified patent and that said Letters Patent is hereby corrected as shown below:

In the Claims

In column 6, claim 1, line 65, after "extended," replace "one of more" with --one or more--.

Signed and Sealed this
Fifth Day of April, 2016

Michelle K. Lee

Michelle K. Lee
*Director of the United States Patent and Trademark Office*